US005808643A

United States Patent [19]

Tracy et al.

[11] Patent Number: 5,808,643

[45] Date of Patent: Sep. 15, 1998

[54] AIR REMOVAL MEANS FOR INK JET PRINTERS

[75] Inventors: Mark D. Tracy, Rochester; Andrew W. Hays, Fairport, both of N.Y.

[73] Assignee: Xerox Corporation, Stamford, Conn.

[21] Appl. No.: 885,431

[22] Filed: Jun. 30, 1997

[51] Int. Cl.[6] ..... B41J 2/19

[52] U.S. Cl. ..... 347/92

[58] Field of Search ..... 347/92, 93, 94

[56] References Cited

U.S. PATENT DOCUMENTS 4,774,530 9/1988 Hawkins ..... 346/140
4,788,556 11/1988 Hoisington et al. ..... 347/92
5,339,102 8/1994 Carlotta ..... 347/32
5,404,158 4/1995 Carlotta et al. ..... 347/32
5,519,425 5/1996 Dietl et al. ..... 347/87

*Primary Examiner*—Benjamin R. Fuller
*Assistant Examiner*—Juanita Stephens

[57] ABSTRACT

A method and apparatus for removing dissolved air in ink and air bubbles or air pockets from ink passageways in ink jet printer cartridges by use of a permeable membrane tubing member positioned in the ink at a location adjacent the ink inlet of the printer's droplet ejecting printhead. The permeable membrane tubing member is connected to a vacuum source to diffuse air into the vacuum in the tubing member interior. The vacuum source may be by a direct connection to the printer's vacuum priming pump at its maintenance station, a separate vacuum pump, or a vacuum accumulator.

9 Claims, 3 Drawing Sheets

AIR REMOVAL MEANS FOR INK JET PRINTERS

BACKGROUND OF THE INVENTION

The present invention relates to ink jet printers and is concerned, more particularly, with removal of both dissolved air in the ink and accumulated air bubbles in the ink supply passageways of the ink jet printers, so that deterioration of print quality is prevented.

It is well known that the printheads for droplet-on-demand type ink jet printers should be free of air pockets or air bubbles for sustained quality printing, for the bubbles restrict the flow of ink to the nozzles when they grow and reach a sufficient size. Not only can the restriction slow the refill of the passageways or channels to the nozzles, but can block the refill and prevent droplet ejection. Although some air bubbles and dissolved air can be tolerated without print quality being impaired, once air bubbles are present, they tend to grow during the printing operation. Therefore, it is highly desirable to provide means to remove air from the ink and air bubbles from the ink supply passageways before the air becomes a problem.

Air is generally removed by priming the printhead at a maintenance station, such as, for example, as disclosed in U.S. Pat. No. 5,404,158. The priming procedure basically sucks ink from the nozzles bringing with it any air bubbles. Even when this deaerating procedure works, it wastes valuable ink which has been purchased by the end user. Also in U.S. Pat. No. 5,339,102, the attempt to remove air bubbles from the printhead is done by a priming operation while the printhead is capped at the maintenance station. Unfortunately, the withdrawal of ink by priming does not always remove ink flow restricting air bubbles from the printhead reservoirs or adjacent ink supply passageways, with the result that some nozzles are starved of ink and fail to eject droplets.

U.S. Pat. No. 4,788,556 discloses a deaerator for removing gas dissolved in hot melt ink at elevated temperatures from molten ink in a hot melt ink jet system. An elongated ink path leading to an ink jet printhead is formed between two gas permeable membranes. The membranes are backed by air plenums which contain support members to hold the membranes in position. Reduced pressure is applied to the plenums to extract dissolved air from the molten ink in the ink path. Increased pressure can also be applied to the plenums to eject ink from the printhead for purging.

Co-pending application 08/867,642, filed May 28, 1997, entitled "Method and Apparatus For Air Removal From Ink Jet Printheads" and assigned to the same assignee as the present invention discloses a decompression technique for removing or relocating air pockets from the reservoirs of ink jet printheads. In one embodiment, an ink jet cartridge, after being filled with ink, is subjected to a relatively high vacuum in a evacutable container. In another embodiment, an accessory kit is used to subject the printhead nozzles and cartridge vent to a high vacuum source after the cartridge is installed in the printer. The nozzles have a higher flow impedance than the printhead ink inlet, so that air bubbles, which expand under a vacuum, move from the printhead reservoir to the cartridge where they do not restrict printhead operation and once removed from the reservoir tend not to reappear there.

SUMMARY OF THE INVENTION

In one aspect of the invention, there is provided a method of removing both dissolved air and air bubbles accumulated in ink flow passageways of an ink jet printer, comprising the steps of: placing at least one gas permeable membrane tubing member in an ink filled passageway of an ink supply system for an ink jet printer, the tubing member having opposing ends, one of which is closed and the other is open; connecting the tubing member open end to a vacuum source; and applying a vacuum from the vacuum source to the tubing member to diffuse air through the tubing member into the vacuum.

In another aspect of the invention, there is provided an ink jet printer having means for removal of both dissolved air in the ink and accumulated air bubbles in ink flow passageways of the ink jet printer, comprising: at least one gas permeable membrane tubing member located in at least one ink filled passageway of an ink supply system for an ink jet printer, the at least one tubing member having opposing ends, one end of which is closed and the other end being open; a vacuum source connected to the tubing member open end; and means for placing a vacuum on the interior of the tubing member from said vacuum source to diffuse air through the tubing member into the vacuum.

BRIEF DESCRIPTION OF THE DRAWINGS

The present invention will now be described by way of example with reference to the accompanying drawings, in which like reference numerals refer to like elements, and wherein.

DESCRIPTION OF THE PREFERRED EMBODIMENT

Figure 1:
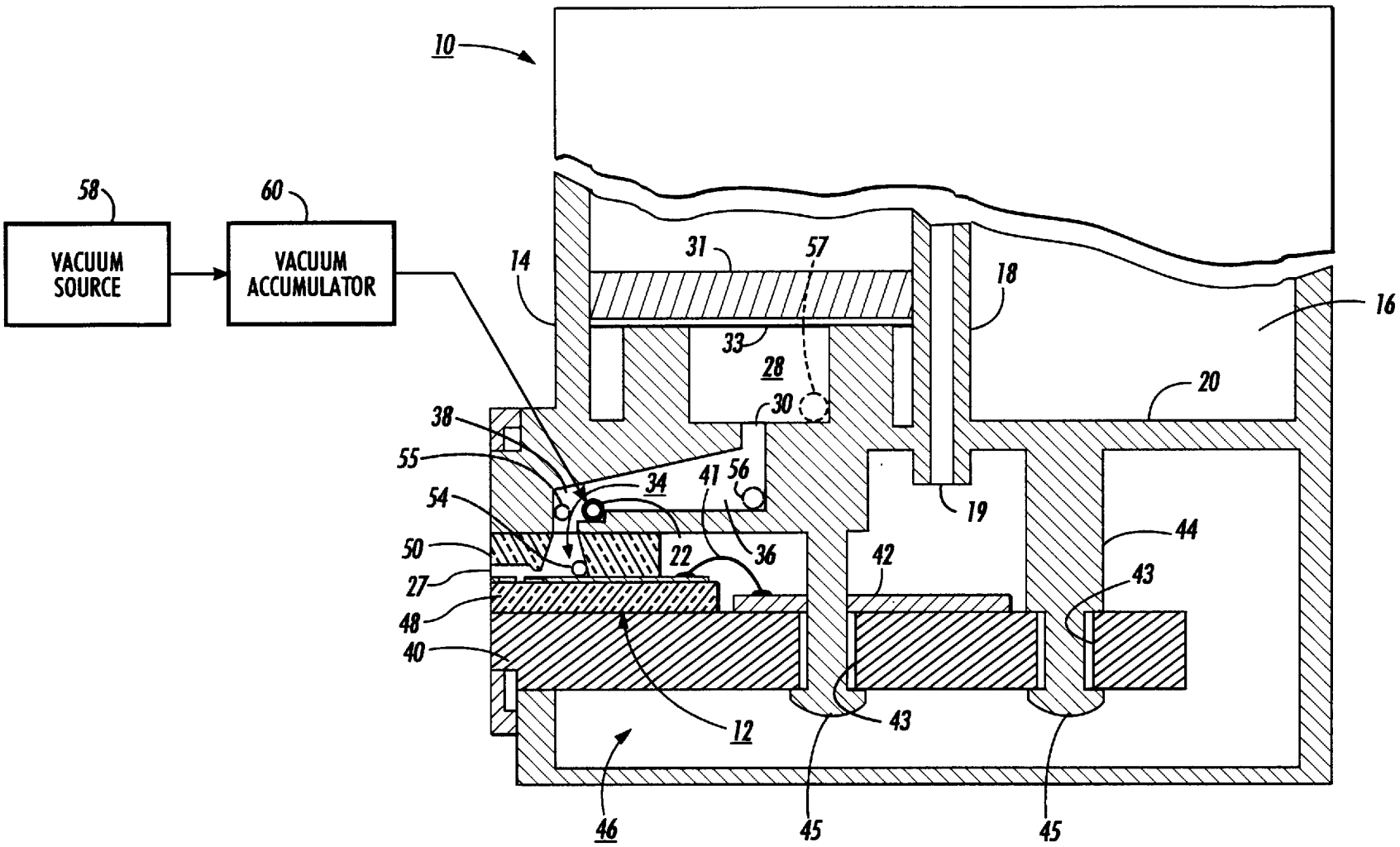
FIG. 1 is a schematic, partially shown and partially sectioned, side elevation view of an ink jet cartridge having an integrally attached printhead showing the means for removal of air of the present invention.

Although the present invention could be used in ink jet printers having either full width array printheads or partial width printheads mounted on translatable carriages, the partial width printhead configuration has been arbitrarily chosen to describe the invention. In FIG. 1, a disposable ink cartridge 10 with integral printhead 12 is shown, similar to the cartridge disclosed in U.S. Pat. No. 5,519,425, which patent is incorporated herein by reference. The cartridge comprises a housing 14 typically made of a lightweight, durable plastic which defines a chamber 16 for storing ink in a first absorbent material (not shown) contained therein, such as, for example, a needled polyester felt. The chamber is hermetically sealed except for the sealed ink flow path to the printhead nozzles, discussed later, and a vent 18 that penetrates the chamber floor 20 and is open via end 19 to the atmosphere. A recess or well 28 is integrally formed in the chamber floor and contains an opening or output port 30 which is connected to a transitioning passageway 36 which connects to an elongated outlet 38 that is substantially perpendicular to the transitioning passageway. Outlet 38 is aligned with and sealed to the ink inlet 32 (FIG. 2) of the printhead reservoir 34. As discussed later, air bubbles form in the ink passageways. To remove any dissolved air in the ink and accumulated air bubbles in accordance with the present invention, a permeable membrane tubing member 22 is installed at the interface between the ink inlet 32 to the printhead reservoir 34 and elongated outlet 38 and subjected to a vacuum to diffuse air through the tubing and into the vacuum, better shown in FIG. 3 discussed later. A second absorbent member 31, having a capillary force greater than the first absorbent material, covers the open end of the well 28. Optionally, a filter 33 is sandwiched between the second absorbent member and the open end of the well 28. The transitioning passageway 36 is geometrically shaped to provide a minimized ink flow resistance and its shape assists in movement of air bubbles therefrom to the cartridge well 28. The transitioning passageway and elongated outlet 38 are better seen in FIG. 2, where they are shown isometrically in phantom line, with this portion of the housing being omitted for clarity.

The printhead 12 and a circuit board 42 are bonded to a heat sink 40 and are electrically connected by wire bonds 41 to form a printhead assembly 46 that is attached to the cartridge housing 14 by stake pins 44 which are integrally formed with the cartridge housing and which are inserted through alignment holes 43 in the heat sink. The stake pins are ultrasonically staked to form fastening heads 45 that fixedly attach the printhead assembly to the cartridge with the printhead reservoir inlet aligned with and sealed to the elongated outlet 38.

Figure 2:
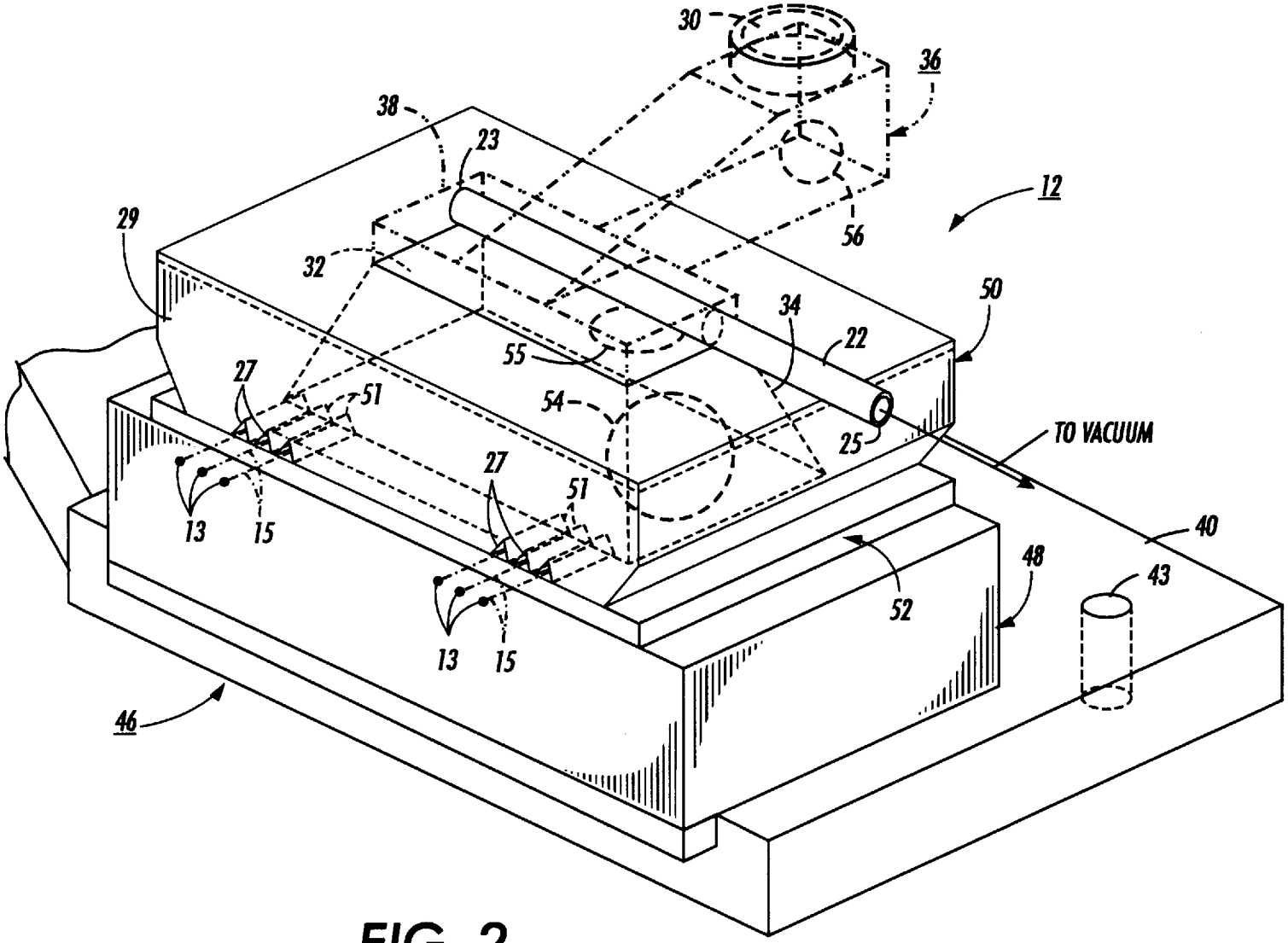
FIG. 2 is a schematic isometric view of the printhead showing the location of the air removal means relative to the ink inlet of the printhead and the ink passageway between the printhead and ink supply cartridge which is shown in phantom line.

An enlarged schematic isometric view of the printhead 12 and heat sink 40 are shown in FIG. 2. The printhead comprises a heater plate 48 having heating elements and addressing electrodes (not shown) and a channel plate 50 having a parallel array of channels 51 (shown in dashed line), one end of which open through the printhead front face 29 and serve as nozzles 27, and a reservoir 34 (shown in dashed line) with inlet 32. The reservoir is in fluid communication with the ends of the channels opposite the channel ends serving as nozzles. A thick film layer 52 such as, for example, polyimide is deposited over the surface of the heater plate containing the heating elements and electrodes and patterned to remove the thick film layer over the heating elements and electrode terminals (not shown), thus placing the heating elements in a pit (not shown) and enabling the wire bonding of the electrode terminals to the printed circuit board 42 (see FIG. 1). The channel plate is bonded to the thick film layer on the heater plate 48 with a heating element in each channel as disclosed in U.S. Pat. No. 4,774,530, which patent is incorporated herein by reference. The printhead 12 is bonded to a heat sink 40 and attached to the cartridge housing 14 as discussed above. For illustration purposes, droplets 13 ejected from the nozzles are shown following trajectories 15.

The transitioning passageway 36 and elongated outlet 38, in the preferred embodiment, are integrally formed in the chamber floor 20 of the cartridge and, in FIG. 2, are shown in phantom line with the portion of the housing 14 containing the transitioning passageway and elongated outlet omitted for ease of understanding the invention and the general location where air pockets or bubbles 55,56 tend to develop or accumulate and grow. An air pocket 54 is shown in dashed line in the printhead reservoir 34, and it is this location that an air bubble is the most likely to restrict ink flow and impact print quality. An air pocket 57 is shown in dashed line in the cartridge well 28 (see FIG. 1). These air bubbles or pockets often form as a result of the initial filling of the cartridge chamber 16 with ink and may even form during the priming of the printhead. Some times these air bubbles form later from dissolved air in the ink when higher operating temperatures cause the dissolved air to leave the ink and accumulate as bubbles. These air pockets do not usually cause any print problems, but if the air pockets 54 in the reservoirs become of a sufficient size, they will cause local ink flow restriction of the ink into the adjacent channels. This flow restriction slows the channel refill process to the point that droplet ejection is prevented from the nozzles of the affected channels. Once the air pockets or bubbles are removed from the printhead reservoirs, the air pockets in the transitioning passageway 36 and cartridge well 28 generally do not impact print quality, for they do not restrict flow to the channels and the channel nozzles.

As disclosed in U.S. Pat. No. 5,339,102, it is well known to provide a maintenance station to provide a means of selectively capping the printhead nozzles with a cap when the printer is not in the printing mode. While capped, the printhead nozzles may be maintained in a humid environment to prevent the exposed ink in the nozzles from drying out, permits the ejection of ink droplets into the cap to prevent slugs of more viscous ink from forming in the nozzles, and to enable the priming of the printhead by subjecting the nozzles to a suction to withdraw ink and suck out any air bubbles that are present with the ink. In the '102 patent, the cap is selectively connected to a low vacuum source of about 120 inches of water for a short period of time. At least portions of the larger air pockets in the printhead reservoirs are removed by such procedure, but at the cost of lost of ink from the fixed ink supply in the cartridge. Though this priming operation generally maintains the print quality, it has been found not to totally remove the smaller air pockets that most times reside in the printhead reservoirs. The air pockets in the printhead reservoir 34 tend to become larger with time and usage, thus requiring periodic priming to maintain suitable print quality and the wasting of ink.

Figure 3:
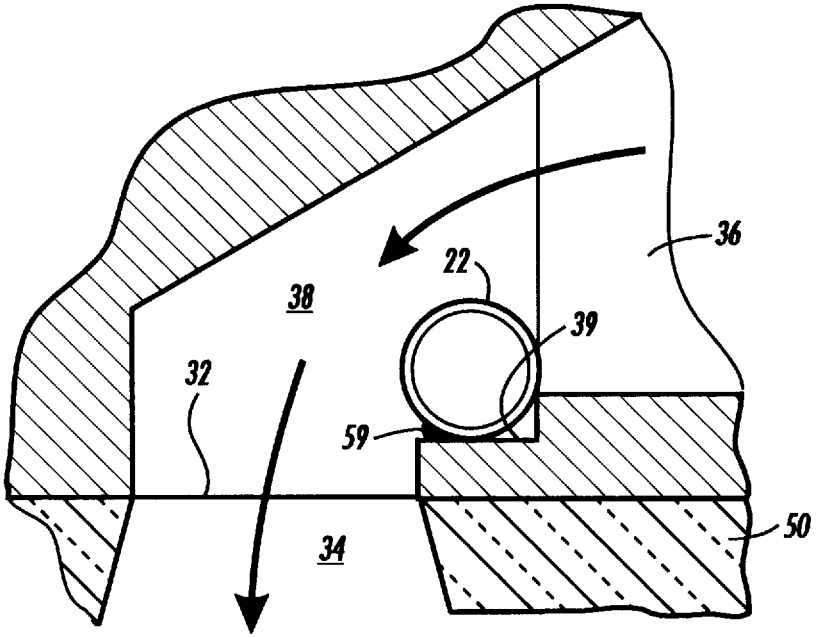
FIG. 3 is an enlarged view of the interface between the printhead ink inlet and the ink supply cartridge outlet showing the air removal means of the present invention.

In the present invention, a gas permeable membrane tubing member 22 is installed within the elongated outlet 38, a portion of the ink flow passageway of the ink jet cartridge 10. The elongated outlet 38 is located at the end of the transitioning passageway 36 opposite the end adjacent the well outlet port 30 and is perpendicular thereto, as shown in FIGS. 2 and 3. The tubing member is immersed in ink at this location and is in close vicinity to the ink inlet 32 of printhead reservoir 34. One end 23 of the tubing member is closed and generally resides in the elongated outlet 38 and the other end portion 25 penetrates the housing via a coupling (not shown) and is connected to a vacuum source 58 which reduces the internal pressure in the tubing member 22. Air molecules dissolved in the ink contacting the outer surface of the tubing member 22 permeate through the tubing member's wall into the low pressure side where they are removed by the vacuum source 58. The air concentration of the ink in the vicinity of the tubing member lowers with the lowest concentration at the surface of the tubing member. Since the tubing member is adjacent the reservoir inlet 32, the air concentration in reservoir lessens and all replacement ink to the reservoir must pass the tubing member. Gas molecules contained in the trapped air bubbles within the ink flow passageways adsorb into the ink and the volume of air bubbles subsequently decrease with time as the air molecules tend to travel to and through the tubing wall thickness to the low pressure side thereof and removed by the vacuum source.

Any suitable gas permeable tubing will suffice. In one embodiment, a Manosil Silicon Rubber® tubing having an outer diameter of ⅛ inch and a wall thickness of 1/32 inch was used. With the tubing member not further from the reservoir than 3 mm, the heat sink temperature measured to be about 35° C., and a 27 inch mercury vacuum applied from a vacuum source, bubbles observed in the printhead reservoir disappeared within 2.5 hours.

In the preferred embodiment, shown in FIG. 3, a shelf 39 is formed in the elongated outlet 38 adjacent the reservoir inlet 32 to better position the tubing member 22, which may be optionably adhered in place by a spot of adhesive 59.

A hole (not shown) may be drilled through the housing and into the elongated outlet, so that the tubing member closed end 23 can be inserted therethrough and then the tubing member 22 is sealed in the drilled hole with an adhesive (not shown), or, in the preferred embodiment, a tubing coupling (not shown) can be sealingly installed in the drilled hole for interconnecting the tubing member with the vacuum source as is well known in the industry.

The invention can be further optimized by determining the minimum tubing member wall thickness, location of the tubing member relative to the reservoir inlet 32, frequency of maintenance firing of ink droplets from the printhead nozzles 27 (FIG. 2) to increase the flow of degassed or deaerated ink into the printhead reservoir 34. The vacuum source 58 can be a separate vacuum source 58, such as a vacuum pump (not shown), or it can utilize the existing vacuum pump (not shown) in the ink jet printer's maintenance station, which is used to prime the printhead while it is capped at the maintenance station (not shown). The typical maintenance station vacuum pump has a capacity suitable for the deaerating of the ink by the tubing member 22; viz., 27 inches of mercury. To enable a constant vacuum on the interior of the tubing member without a constantly running vacuum pump, a vacuum accumulator 60 may optionally be used. The vacuum accumulator 60 is monitored for vacuum pressure and when the pressure is out of the allocated range, such as 27 to 29 inches of mercury, the vacuum source pumps down the vacuum accumulator until it is within the appropriate vacuum pressure. Any suitable form of vacuum, such as a consumable cylinder or vacuum hand pump, would be appropriate, provided all of the factors and parameters of the inventive system were designed to work at the level of vacuum available.

Figure 4:
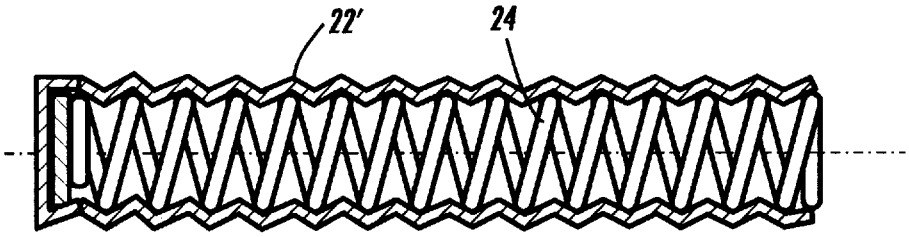
FIG. 4 is a partially sectioned front view of an alternate embodiment of the membrane tubing member of FIGS. 1 and 3, showing an internal spiral support member.

In FIG. 4, a partially cross sectioned side view of an alternate embodiment of the gas permeable membrane tubing member 22' is shown with an internal spiral support member 24, such as a spiral spring, inserted therein. This support member enables the use of a tubing member having a wall thickness so thin that it collapses when a vacuum is internally placed in it, for the support member maintains the appropriate internal diameter of the thin walled tubing member. The benefit of a thin walled tubing member is that it is very efficient in withdrawing air dissolved or otherwise from the ink. The permeable membrane tubing member with an internal support member may have a wall thickness about 1 to 2 mils or 25 to 50 $\mu$m.

While the invention has been described with reference to specific embodiments, the description of the specific embodiments is illustrative only and is not to be construed as limiting the scope of the invention. For example, the gas permeable tubing member could be positioned in more than one location within the cartridge ink flow passageways. Various other modifications and changes may occur to those skilled in the art without departing for the spirit and scope of the invention.

We claim:

1. A method of removing both dissolved air and air bubbles accumulated in ink flow passageways of an ink jet printer, comprising the steps of:

placing at least one gas permeable membrane tubing member having an outside surface in an ink filled passageway of an ink supply system for an ink jet printer, the tubing member having opposing ends, one of which is closed and another is open;

connecting the tubing member open end to a vacuum source; and applying a vacuum from the vacuum source to the tubing member to remove air from the ink in a vicinity of the tubing member and diffuse the air through an said outside surface of the tubing member into the vacuum within the tubing member.

2. The method as claimed in claim 1, wherein the ink filled passageway of the ink supply system includes a droplet ejecting printhead; and wherein the tubing member is at a location adjacent an inlet of a reservoir for the printer's printhead.

3. The method as claimed in claim 2, wherein the method further comprises the step of inserting a support member into the tubing member to keep the tubing member from collapsing under the vacuum.

4. An ink jet printer having means for removal of both dissolved air in ink and accumulated air bubbles in ink flow passageways of the ink jet printer, comprising:

at least one gas permeable membrane tubing member located in at least one ink filled passageway of an ink supply system for an ink jet printer, the at least one tubing member having opposing ends, one end of which is closed and another end being open;

a vacuum source connected to the tubing member open end; and means for placing a vacuum on an interior of the tubing member from said vacuum source to diffuse air through an outside surface of the tubing member into the interior of the tubing member.

5. The printer as claimed in claim 4, wherein the printer has a droplet ejecting printhead, the printhead having a reservoir with an inlet, a plurality of nozzles from which the droplets are ejected, and a channel connecting each nozzle to the reservoir; and wherein the tubing member is located adjacent the reservoir inlet, so that all of replenishing ink entering the printhead's reservoir is obtained from the ink residing in a vicinity of the tubing member.

6. The printer as claimed in claim 5, wherein the printer further comprises a vacuum accumulator interconnected between the vacuum source and the tubing member open end.

7. The printer as claimed in claim 6, wherein tubing member has an outer diameter of ⅛ inch and a wall thickness of 1/32 inch; and wherein the vacuum applied to an interior of the tubing member is about 27 inches of mercury.

8. The printer as claimed in claim 6, wherein the tubing member has inserted therein a spiral support member; wherein the tubing member has an outer diameter of about ⅛ inch and a wall thickness of about 1 to 2 mils; and wherein the vacuum applied to an interior of the tubing member is about 27 inches of mercury, the support member being prevented from collapsing under the vacuum by said spiral support member.

9. The printer as claimed in claim 6, wherein the printer has a vacuum pump for priming the printhead; and wherein the vacuum source is said printing vacuum pump.

* * * * *